US008166936B2

(12) United States Patent
Fujiyoshi

(10) Patent No.: US 8,166,936 B2
(45) Date of Patent: May 1, 2012

(54) VALVE TIMING ADJUSTING APPARATUS

(75) Inventor: Toshiki Fujiyoshi, Okazaki (JP)

(73) Assignee: Denso Corporation, Kariya (JP)

( * ) Notice: Subject to any disclaimer, the term of this patent is extended or adjusted under 35 U.S.C. 154(b) by 300 days.

(21) Appl. No.: 12/702,507

(22) Filed: Feb. 9, 2010

(65) Prior Publication Data

US 2010/0199937 A1 Aug. 12, 2010

(30) Foreign Application Priority Data

Feb. 9, 2009 (JP) ..... 2009-27650

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/1, 2, 160
See application file for complete search history.

(56) References Cited

U.S. PATENT DOCUMENTS

| | | | |
|---|---|---|---|
| 5,870,983 | A | 2/1999 | Sato et al. |
| 6,311,654 | B1 | 11/2001 | Ushida et al. |
| 6,439,184 | B1 | 8/2002 | Takenaka et al. |
| 6,457,447 | B1 | 10/2002 | Sato et al. |
| 7,363,897 | B2 | 4/2008 | Fischer et al. |
| 7,614,370 | B2 * | 11/2009 | Fischer et al. ..... 123/90.15 |
| 2001/0039933 | A1 | 11/2001 | Sato et al. |

FOREIGN PATENT DOCUMENTS

| | | |
|---|---|---|
| JP | 10-68306 | 3/1998 |
| JP | 2000-45722 | 2/2000 |
| JP | 2000-179314 | 6/2000 |
| JP | 2007-327490 | 12/2007 |

OTHER PUBLICATIONS

Japanese Office Action dated Jan. 6, 2011, issued in corresponding Japanese Application No. 2009-027650 with English Translation.

* cited by examiner

*Primary Examiner* — Ching Chang
(74) *Attorney, Agent, or Firm* — Nixon & Vanderhye PC

(57) ABSTRACT

A valve timing adjusting apparatus includes a housing, a vane rotor, and a spiral spring. The spiral spring has a most radially inward part engaged with a rotational shaft of the vane rotor in a state, where the most radially inward part is wound around the rotational shaft. The rotational phase has an intermediate position defined between a full retard position and a full advance position of the rotational phase. The spiral spring has a radially outward segment that is located radially outward of the most radially inward part. When the rotational phase is in a range on a retard side of the intermediate position or on an advance side of the intermediate position, the radially outward segment is engaged with the stopper such that the spiral spring urges the vane rotor in the advance direction or in the retard direction relative to the housing, respectively.

8 Claims, 14 Drawing Sheets

VALVE TIMING ADJUSTING APPARATUS

CROSS REFERENCE TO RELATED APPLICATION

This application is based on and incorporates herein by reference Japanese Patent Application No. 2009-27650 filed on Feb. 9, 2009.

BACKGROUND OF THE INVENTION

1. Field of the Invention

The present invention relates to a valve timing adjusting apparatus for an internal combustion engine, wherein the valve timing adjusting apparatus adjusts valve timing of a valve that is opened and closed by a camshaft based on torque transmitted from a crankshaft.

2. Description of Related Art

Conventionally, a valve timing adjusting apparatus, which has a housing and a vane rotor, has been widely used. For example, the housing of the conventional valve timing adjusting apparatus is synchronously rotated with a crankshaft, and the vane rotor is synchronously rotated with a camshaft. In the above valve timing adjusting apparatus, vanes of the vane rotor divides the internal space of the housing into retard chambers and advance chambers that are arranged in the rotational direction. By supplying working fluid into the retard chamber or the advance chamber, a rotational phase of the vane rotor relative to the housing (hereinafter, referred merely as a "rotational phase") is shifted in a retard direction or in an advance direction such that desired valve timing is achieved (see, for example, JP-A-2007-327490 corresponding to U.S. Pat. No. 7,363,897).

The valve timing adjusting apparatus of JP-A-2007-327490 holds the rotational phase at an intermediate position located between the retard end and the advance end of the rotational phase such that the performance of starting the internal combustion engine is sufficiently achieved. Specifically, the valve timing adjusting apparatus of JP-A-2007-327490 has a helical torsion spring having a fixed end that is always engaged with the housing. The other end of the helical torsion spring is a free end. When the rotational phase is in a range on a retard side of the intermediate position, the free end of the helical torsion spring is engaged with the vane rotor such that the vane rotor is urged in the advance direction relative to the housing. Due to the above, at the stopping of the internal combustion engine, until the rotational phase becomes the intermediate position, the vane rotor remains urged by the helical torsion spring in the advance direction, and thereby the vane rotor rotates relative to the housing in the advance direction. As a result, it is possible to hold the rotational phase at the intermediate position during the starting of the internal combustion engine such that the startability of the engine is substantially achieved.

In the valve timing adjusting apparatus of JP-A-2007-327490, the helical torsion spring is located at a position radially outward of a bush that serves as a rotational shaft of the vane rotor. As described above, when the rotational phase is in the range on the retard side of the intermediate position, the free end of the helical torsion spring is engaged with the vane rotor, and thereby the helical torsion spring urges the vane rotor in the advance direction. In contrast, when the rotational phase is in a range on an advance side of the intermediate position, the free end of the helical torsion spring is engaged with the housing such that the vane rotor is prevented from being urged by the spring.

As above, the fixed end of the helical torsion spring is always engaged with the housing, and the free end of the helical torsion spring is engageable with the vane rotor or the housing. In order to mechanically stabilize the helical torsion spring having the above configuration, the helical torsion spring is brought into point-contact with the bush located on the radially inward of the helical torsion spring such that the helical torsion spring applies load to the bush. As a result, when the vane rotor rotates relative to the housing, the helical torsion spring deforms and also slides on the bush accordingly to the relative rotation of the vane rotor. Therefore, sliding resistance may be generated. More specifically, the sliding resistance is generated in opposite directions when the vane rotor is rotated in the retard direction and in the advance direction relative to the housing. In other words, shifting of the rotational phase in the retard direction and in the advance direction generates the friction applied in the opposite directions. As a result, torque is applied to the vane rotor by the urging force of the helical torsion spring and by the frictional force of the sliding resistance. Thus, the applied torque generates hysteresis that has a great difference between the shift of the rotational phase in the retard direction and in the advance direction as shown in FIG. 17. The above hysteresis may deteriorate the accuracy in adjusting the rotational phase or the valve timing by using working fluid, and thereby needs to be improved.

SUMMARY OF THE INVENTION

The present invention is made in view of the above disadvantages. Thus, it is an objective of the present invention to address at least one of the above disadvantages.

To achieve the objective of the present invention, there is provided a valve timing adjusting apparatus for an internal combustion engine having a crankshaft and a camshaft, wherein the valve timing adjusting apparatus adjusts valve timing of a valve that is opened and closed by the camshaft based on torque transmitted from the crankshaft. The valve timing adjusting apparatus includes a housing, a vane rotor, and a spiral spring. The housing is rotatable synchronously with the crankshaft, wherein the housing has a stopper. The vane rotor integrally includes a rotational shaft and a vane. The rotational shaft is rotatable synchronously with the camshaft. The vane defines within the housing an advance chamber and a retard chamber that are arranged one after another in a rotational direction of the vane rotor. Supply of working fluid to the retard chamber or the advance chamber shifts a rotational phase of the vane rotor relative to the housing in a retard direction or in an advance direction, respectively. The spiral spring has a most radially inward part engaged with the rotational shaft in a state, where the most radially inward part is wound around the rotational shaft. The rotational phase has an intermediate position defined between a full retard position and a full advance position of the rotational phase. The spiral spring has a radially outward segment that is located at a position radially outward of the most radially inward part. When the rotational phase is in a range on a retard side of the intermediate position or on an advance side of the intermediate position, the radially outward segment of the spiral spring is engaged with the stopper of the housing such that the spiral spring urges the vane rotor in the advance direction or in the retard direction relative to the housing, respectively.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Multiple embodiments of the present invention will be described with reference to accompanying drawings. Components of each of the embodiments, which are similar to each other, are indicated by the same numerals, and the redundant explanation will be omitted.

First Embodiment

Figure 1:
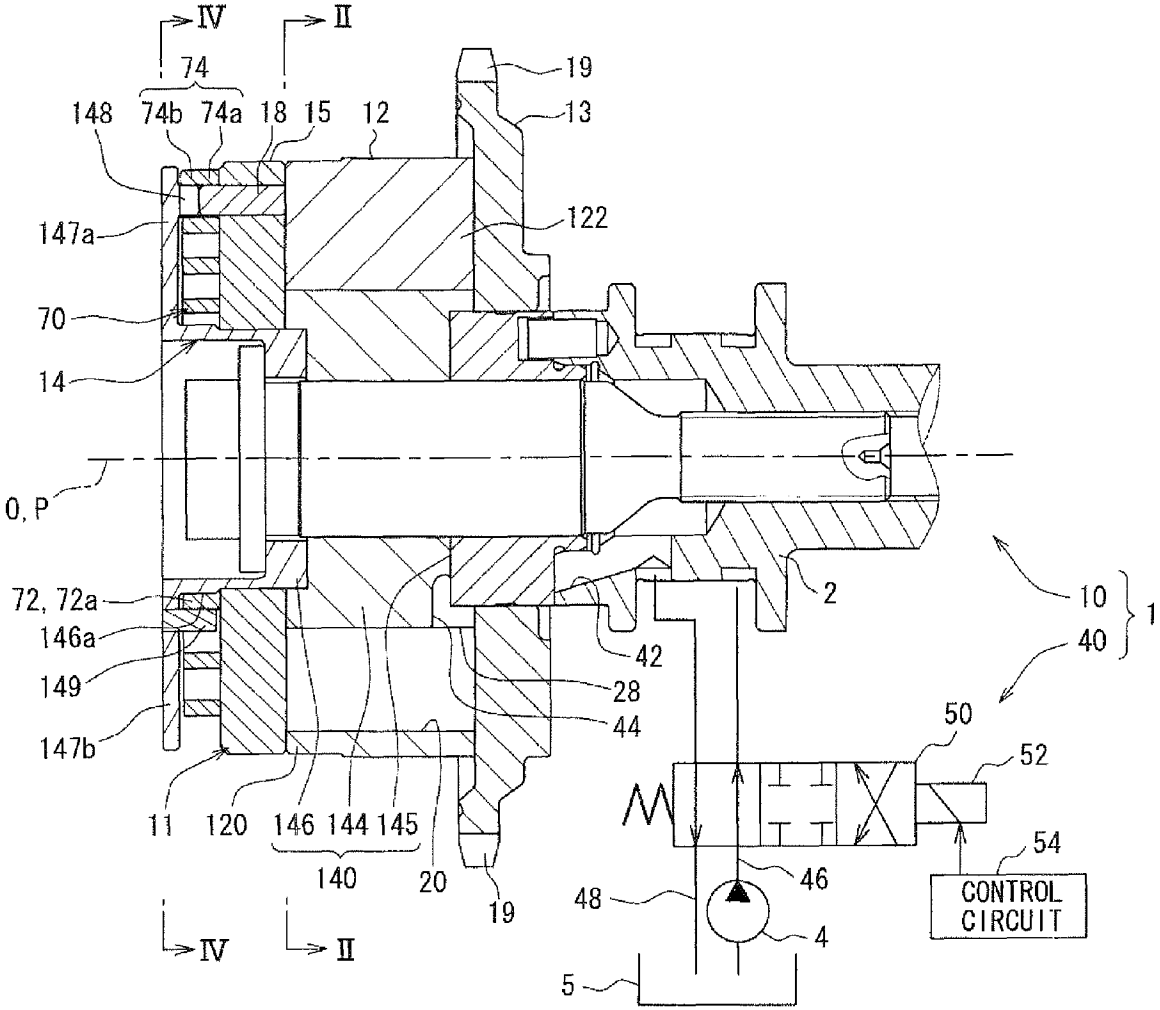
FIG. 1 is a cross-sectional view taken along a line I-I in FIG. 2 for illustrating a valve timing adjusting apparatus according to the first embodiment of the present invention.

FIG. 1 shows an example, in which a valve timing adjusting apparatus 1 according to the first embodiment of the present invention is applied to an internal combustion engine of a vehicle. The valve timing adjusting apparatus 1 adjusts valve timing of an intake valve by using hydraulic oil that serves as "working fluid". The intake valve serves as a "valve" that is opened and closed by a camshaft 2 of the engine. The valve timing adjusting apparatus 1 is mounted on a transmission system that transmits engine torque from a crankshaft (not shown) of the engine to the camshaft 2. The valve timing adjusting apparatus 1 includes a drive unit 10 and a control unit 40. The drive unit 10 is driven by hydraulic oil, and the control unit 40 controls supply of hydraulic oil.

(Drive Unit)

Firstly, the drive unit 10 will be detailed. The drive unit 10 shown in FIG. 1 and FIG. 2 has a housing 11 that includes a shoe housing 12, a sprocket 13, and a front plate 15.

The shoe housing 12 is made of a metal and has a hollow cylindrical housing main body 120 and multiple shoes 121, 122, 123 that serves as partitioning parts. Each of the shoes 121, 122, 123 projects from the housing main body 120 in a radially inward direction of the housing 11, and the shoes 121, 122, 123 are arranged in a rotational direction of the housing 11 at predetermined intervals. Each of the shoes 121, 122, 123 has a projection end that has an arc surface when taken along a plane perpendicular to a longitudinal axis of the housing 11. The projection end surface of the each shoe slides on an outer peripheral surface of rotational shaft 140 of a vane rotor 14, which will be described later. Receiving chambers 20 are formed between the adjacent shoes 121, 122, 123 that are arranged adjacently in the rotational direction.

Each of the sprocket 13 and the front plate 15 is made of a metal and has an annular plate shape, and is fixed to the respective longitudinal end portion of the shoe housing 12. The sprocket 13 has multiple teeth 19 that radially outwardly project therefrom. The toothed sprocket 13 is connected to the crankshaft through a timing chain (not shown) that is engaged with the teeth 19 of the sprocket 13. Thus, during the operation of the internal combustion engine, engine torque is transmitted from the crankshaft to the sprocket 13, and thereby the housing 11 moves synchronously with the crankshaft to rotate clockwise in FIG. 2.

The vane rotor 14 is made of a metal and is coaxially received within the housing 11. The vane rotor 14 has both longitudinal ends that slid on the sprocket 13 and the front plate 15 of the housing 11, respectively. The vane rotor 14 has the hollow cylindrical rotational shaft 140 and vanes 141, 142, 143.

The rotational shaft 140 is coaxially fixed to the camshaft 2. Thus, the vane rotor 14 is rotatable synchronously with the camshaft 2 clockwise in FIG. 2, and is rotatable relative to the housing 11. The rotational shaft 140 of the present embodiment has a shaft main body 144, a hub 145, and a bush 146. The hub 145 is fixed to one end of the shaft main body 144. The hub 145 longitudinally extends through the sprocket 13 to be fixed to the camshaft 2 that is located outside the housing 11. The bush 146 is fixed to the other end of the shaft main body 144. The bush 146 longitudinally extend through the front plate 15 to open to the exterior of the housing 11. Each of the vanes 141, 142, 143 are provided to the shaft main body 144 of the rotational shaft 140. Each of the vanes 141, 142, 143 radially outwardly projects from the shaft main body 144 at positions arranged in the rotational direction at predetermined intervals such that each of the vanes 141, 142, 143 is received within the respective receiving chamber 20. Each the vanes 141, 142, 143 has a projection end that has an arc shape when taken along the plane perpendicular to the longitudinal axis of the housing 11. The arc-shaped surfaces of the projection ends of the vanes slide on the radially inward surface of the housing main body 120.

Each of the vanes 141, 142, 143 divides the corresponding receiving chamber 20 into an advance chamber 22, 23, 24 and a retard chambers 26, 27, 28 that are arranged in the rotational direction within the housing 11. Specifically, the advance chamber 22 is formed between the shoe 121 and the vane 141, the advance chamber 23 is formed between the shoe 122 and the vane 142, and the advance chamber 24 is formed between the shoe 123 and the vane 143. The advance chambers 22, 23, 24 are increased in volume upon the introduction of hydraulic oil thereto, and thereby the vanes 141, 142, 143 are pressed against the shoes 121, 122, 123 in the advance direction, respectively. In contrast, the retard chamber 26 is formed between the shoe 122 and the vane 141, the retard chamber 27 is formed between the shoe 123 and the vane 142, and the retard chamber 28 is formed between the shoe 121 and the vane 143. The retard chambers 26, 27, 28 are increased in volume upon the introduction of hydraulic oil thereto, and thereby the vanes 141, 142, 143 are pressed against the shoes 122, 123, 121 in the retard direction, respectively.

In the above drive unit 10, the introduction of hydraulic oil into the advance chambers 22, 23, 24 and the discharge of hydraulic oil from the retard chambers 26, 27, 28 shifts the rotational phase in advance direction, and thereby the valve timing is advanced accordingly. In contrast, the introduction of hydraulic oil to the retard chambers 26, 27, 28 and the discharge of hydraulic oil from the advance chambers 22, 23, 24 shifts the rotational phase in retard direction, and thereby the valve timing is retarded accordingly.

Figure 2:
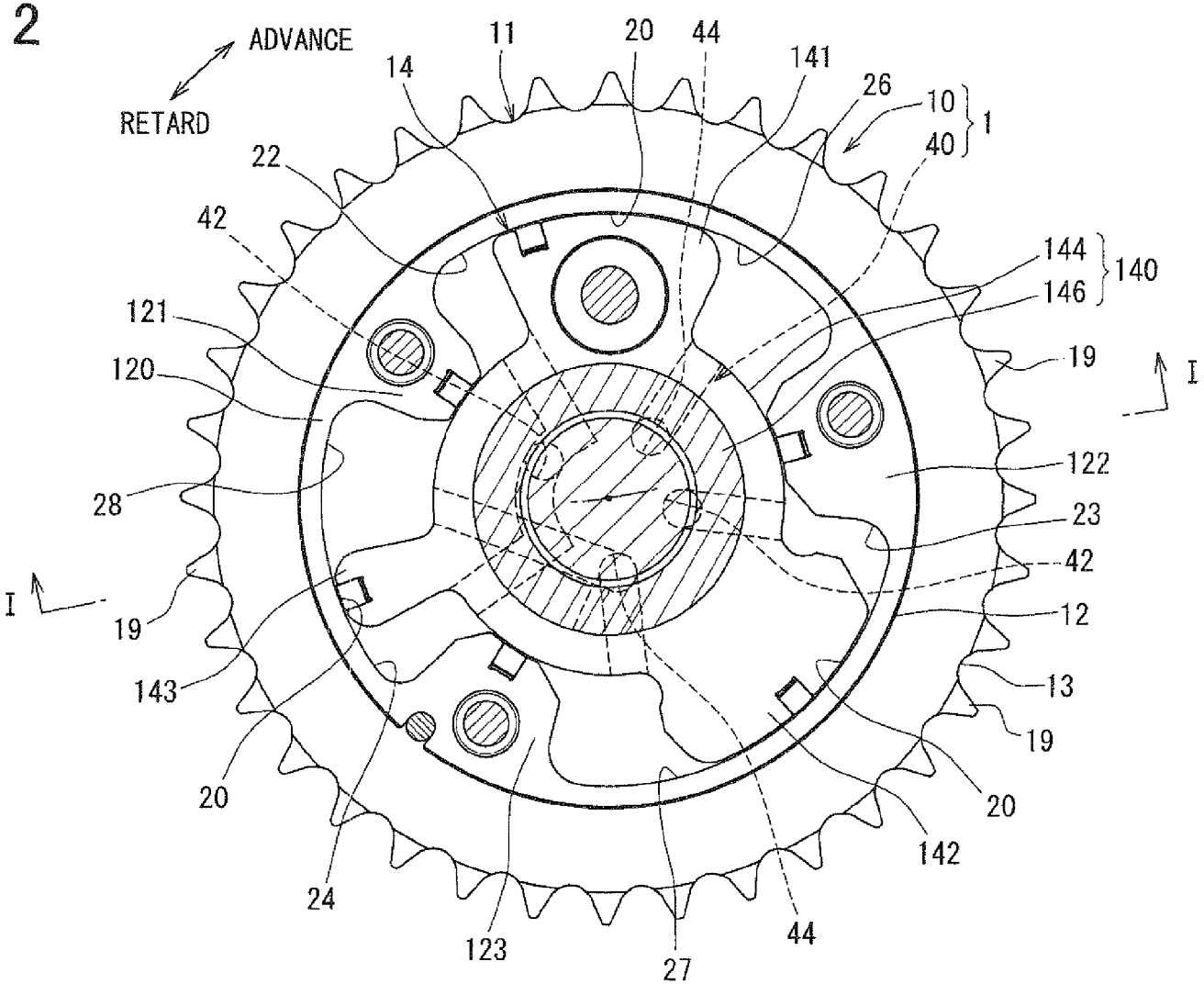
FIG. 2 is a cross-sectional view of a drive unit taken along line II-II in FIG. 1.

The rotational phase provided by the operational state shown in FIG. 2 corresponds to a start phase, which is an intermediate position defined between an advance end (full advance position) and a retard end (full retard position), and which is suitable for achieving the substantial performance for starting the internal combustion engine. The start phase of the present embodiment is designed such that, for example, excessive decrease of an intake air amount into cylinders of the internal combustion engine during the cranking due to the delay of closing the intake valve is limited, and thereby the substantial performance for starting the internal combustion engine is achievable.

(Control Unit)

Next, the control unit 40 will be detailed. In the control unit 40 shown in FIG. 1 and FIG. 2, an advance passage 42 is provided to extend through the camshaft 2, and is always communicated with the advance chambers 22, 23, 24 regardless of change of the rotational phase. Also, a retard passage 44 is provided to extend through the camshaft 2, and is always communicated with the retard chambers 26, 27, 28 regardless of the change of the rotational phase.

A supply passage 46 shown in FIG. 1 is communicated with a discharge port of a pump 4 that serves as a supplier, and hydraulic oil is suctioned from an oil pan 5 into an inlet port of the pump 4. Then, the suctioned hydraulic oil is discharged through the discharge port. The pump 4 of the present embodiment is a mechanical pump that is driven by the crankshaft based on the rotation of the internal combustion engine, and thereby is kept driven until the stop of the internal combustion engine. Also, a drain passage 48 is provided to the oil pan 5 for draining hydraulic oil thereto.

A phase control valve 50 is mechanically connected with the advance passage 42, the retard passage 44, the supply passage 46, and the drain passage 48. the phase control valve 50 is operated based on the energization of a solenoid 52 such that the phase control valve 50 switches the communication of each of the supply passage 46 and the drain passage 48 with a corresponding one of the advance passage 42 and the retard passage 44.

A control circuit 54 mainly includes a microcomputer, and the control circuit 54 is electrically connected with the solenoid 52 of the phase control valve 50. The control circuit 54 controls energization to the solenoid 52 and controls the operation of the internal combustion engine.

In the above control unit 40, the phase control valve 50 is operated based on the energization to the solenoid 52 that is controlled by the control circuit 54 such that communication state of the supply passage 46 and the drain passage 48 relative to the advance passage 42 and the retard passage 44, respectively, is switched. as a result, when the advance passage 42 and the retard passage 44 are communicated with the supply passage 46 and the drain passage 48, respectively, hydraulic oil from the pump 4 is introduced into the advance chambers 22, 23, 24 through the passages 46, 42, and thereby hydraulic oil in the retard chambers 26, 27, 28 is discharged to the oil pan 5 through the passages 44, 48. Thus, in the above, the rotational phase is shifted in the advance direction such that the valve timing is advanced. In contrast, when the retard passage 44 and the advance passage 42 are communicated with the supply passage 46 and the drain passage 48, respectively, hydraulic oil from the pump 4 is introduced into the retard chambers 26, 27, 28 through the passages 46, 44, and thereby hydraulic oil in the advance chambers 22, 23, 24 through the oil pan 5 the passages 42, 48. Thus, in the above, the rotational phase is shifted in the retard direction, and thereby the valve timing is retarded.

(Characteristic Configuration)

Characteristic configuration of the valve timing adjusting apparatus 1 will be detailed below.

(Operational Structure of Variable Torque)

Figure 3:
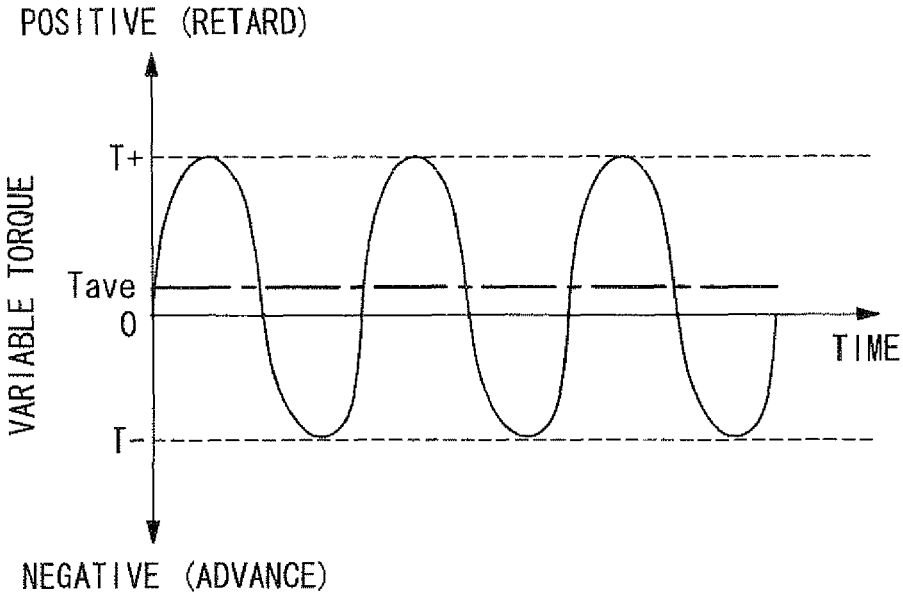
FIG. 3 is a schematic diagram for explaining variable torque applied to the drive unit in FIG. 1.

In the drive unit 10, the camshaft 2 is fixed to the rotational shaft 140 of the vane rotor 14. Thus, variable torque (torque reversal) is applied to the vane rotor 14 due to the spring reaction force of a valve spring of the intake valve that is opened and closed by the camshaft 2 during the rotation of the internal combustion engine. As shown in the example of FIG. 3, the variable torque alternately changes between negative torque and positive torque. The negative torque urges the vane rotor 14 relative to the housing 11 in the advance direction, and the positive torque urges the vane rotor 14 relative to the housing 11 in the retard direction. In the variable torque of the present embodiment, an absolute value of a peak torque value T+ of the positive torque is greater than an absolute value of a peak torque value T− of the negative torque because of friction between the camshaft 2 and a bearing that holds the camshaft 2. As a result, an average torque value Tave tends to stay in the positive torque as shown in FIG. 3. Thus, during the rotation of the internal combustion engine, the vane rotor 14 is urged, in average, relative to the housing 11 in the retard direction because of the variable torque transmitted to the vane rotor 14 through the camshaft 2.

(Urging Structure)

Figure 4:
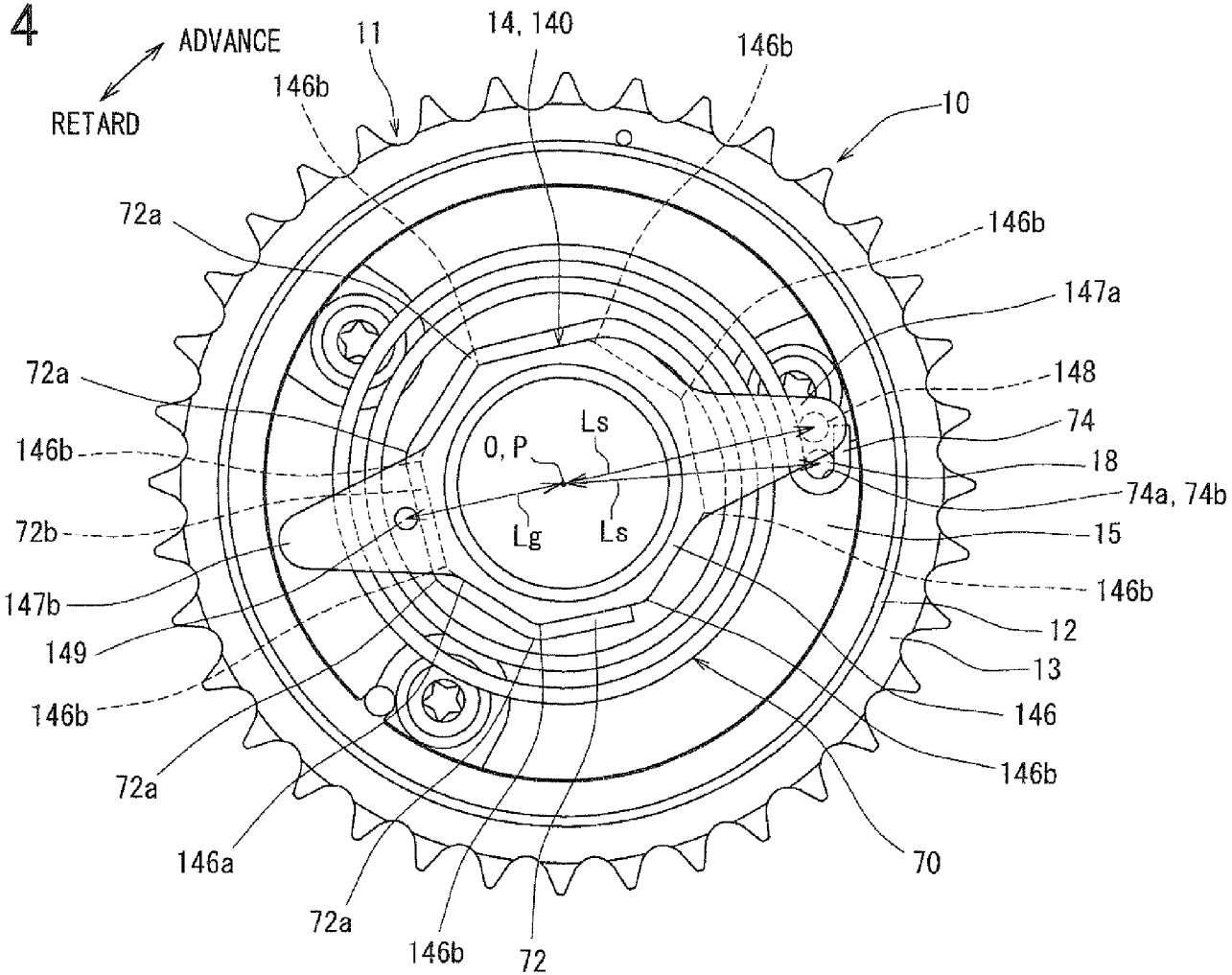
FIG. 4 is a diagram of the drive unit observed in a direction shown by a line IV-IV of FIG. 1.
Figure 5B:
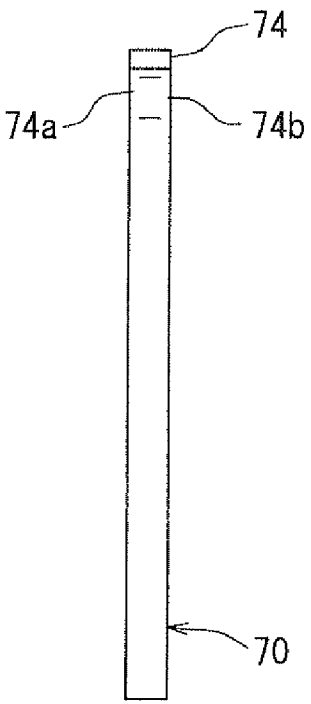
FIG. 5B is a side view of the spiral spring show in FIG. 4.
Figure 5A:
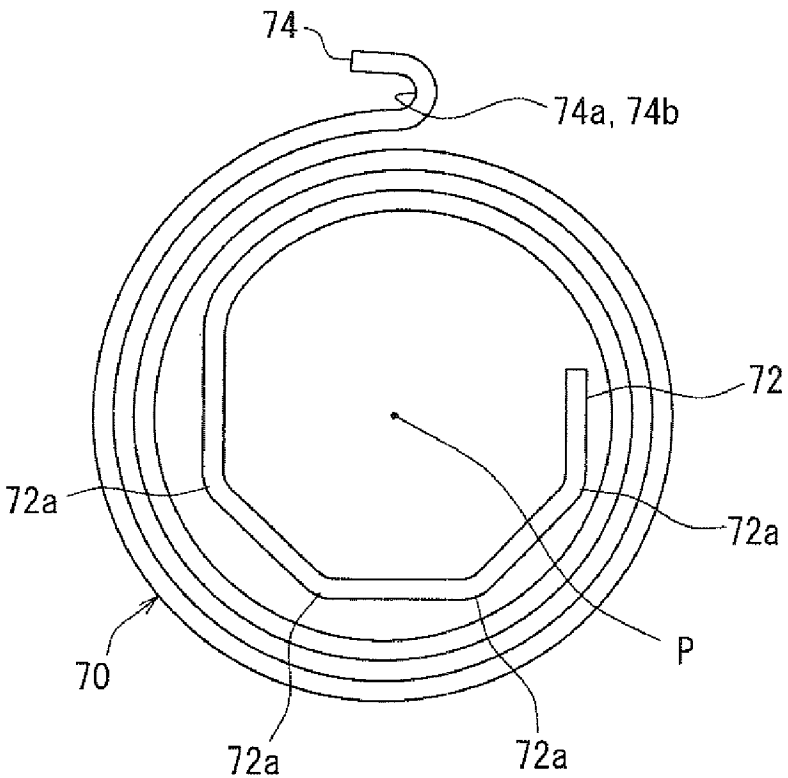
FIG. 5A is a plan view of a spiral spring show in FIG. 4.

In the drive unit 10 shown in FIGS. 1 and 4, the housing 11 has a first stopper 18, which is fixed to the front plate 15, and which projects in a direction away from the shoe housing 12. Also, the first stopper 18 is made of metal. Typically, the first stopper 18 of the present embodiment is a column pin that projects in a longitudinal direction of the rotational shaft 140 from a position that is off a rotation center O of the rotational shaft 140 by a preset distance Ls. In other words, the column pin projects from the position that is radially away from the rotation center O by the preset distance Ls.

In the vane rotor 14, the bush 146 of the rotational shaft 140 projects from the front plate 15 in a direction away from the shoe housing 12. More specifically, the bush 146 has an outer peripheral surface 146*a* that has an octagonal shape when taken along a plane perpendicular to the longitudinal axis of the bush 146. The corners of octagonal shape of the outer peripheral surface 146*a*, which project radially outwardly, correspond to eight corner portions 146*b* that are arranged one after another in the rotational direction. The vane rotor 14 further has a pair of arms 147*a*, 147*b* that project from the bush 146 in opposite radial directions. Each of the pair of arms 147*a*, 147*b* has a flat plate shape. One arm 147*a* integrally has a second stopper 148 that projects therefrom toward the front plate 15. The second stopper 148 is made of a metal. The second stopper 148 of the present embodiment is a column pin that projects in the longitudinal direction of the rotational shaft 140 from a position that is off the rotation center O of the rotational shaft 140 by a distance that is substantially similar to the distance Ls, by which the first stopper 18 is off the rotation center O. Also, the second stopper 148 is displaced from the first stopper 18 in the longitudinal direction of the rotational shaft 140 such that the second stopper 148 is limited from overlapping the first stopper 18 in the rotational direction. As shown in FIG. 4, the other arm 147*b* has a metal guide 149, which is fixed thereto, and which projects from the other arm 147*b* toward the front plate 15. The guide 149 of the present embodiment is a column pin that projects in the longitudinal direction of the rotational shaft 140 from a position that is off the rotation center O by a distance Lg that is smaller than the distance Ls, by which the stoppers 18, 148 are off the rotation center O.

In the rotational shaft 140, a metal spiral spring 70 is provided at a position radially outward of the bush 146. As shown in FIGS. 1, 4, 5A, and 5B, the spiral spring 70 is a flat hairspring that is substantially formed in a spiral manner on a plane. Also, the spiral spring 70 is made of a wire, spiral parts of which do not contact each other in a radial direction. In other words, parts of the hairspring is spaced apart from each other in the radial direction of the spiral spring 70. For example, the spiral spring 70 is positioned between the front plate 15 and the arms 147*a*, 147*b* in a state, where a spiral center P of the spiral spring 70 is located at a position of the rotation center O of the rotational shaft 140.

In the spiral spring 70 shown in FIG. 4, a most radially inward part 72 corresponds to an inner end of the wire of the spiral spring 70. The most radially inward part 72 has four corners 72*a* that are arranged within an angular range of at least 180 degree in the rotational direction of the rotational shaft 140 (see FIGS. 4 and 5). Also, the four corners 72*a* are made by bending the most radially inward part 72 such that the four corners 72*a* are arranged along the outer peripheral surface 146*a* of the bush 146. Each corner 72*a* is fitted with the respective corner portion 146*b* that are formed at the outer peripheral surface 146*a* of the bush 146. Thus, the most radially inward part 72 of the spiral spring 70 extends over the four corner portions 146*b*, which are arranged within the angular range of at least 180 degree in the rotational direction, such that the most radially inward part 72 is wound around the bush 146. As a result, the spiral spring 70 is limited from being displaced from the rotational shaft 140 in the both rotational directions. For example, the four corners 72*a* includes the second corner 72*a* and the third corner 72*a* that are counted from the inner end of the most radially inward part 72 of the spiral spring 70. The most radially inward part 72 further has a linear part 72*b*, which connects the second corner 72*a* with the third corner 72*a*, and which is provided radially between the guide 149 and the outer peripheral surface 146*a* of the bush 146. Thus, the displacement of the most radially inward part 72 of the spiral spring 70 from the position, at which the most radially inward part 72 is engaged with the rotational shaft 140, is effectively limited. As a result, in the present embodiment, fusion through melting or adhesion is not required to fix the spiral spring 70 to the rotational shaft 140. However, the above fixing method (fusion, adhesion, for example) may be employed alternatively to fix the spiral spring 70.

The spiral spring 70 shown in FIG. 4 has a most radially outward part 74 that is an end of a segment (radially outward segment) of the spiral spring 70 positioned radially outward of the most radially inward part 72. For example, the most radially outward part 74 is a radially outer end of the wire of the spiral spring 70. The most radially outward part 74 is bent to have a U-shape, and the most radially outward part 74 has first and second engagement parts 74*a*, 74*b* that are arranged one after another in a direction perpendicular to the plane of the flat spring (see FIGS. 4, 5A, 5B, and 8). The first and second engagement parts 74*a*, 74*b* are formed at a position that is off the rotation center O of the rotational shaft 140 by a distance that is substantially similar to the distance Ls, by which the stoppers 18, 148 are off the rotation center O.

Figure 6:
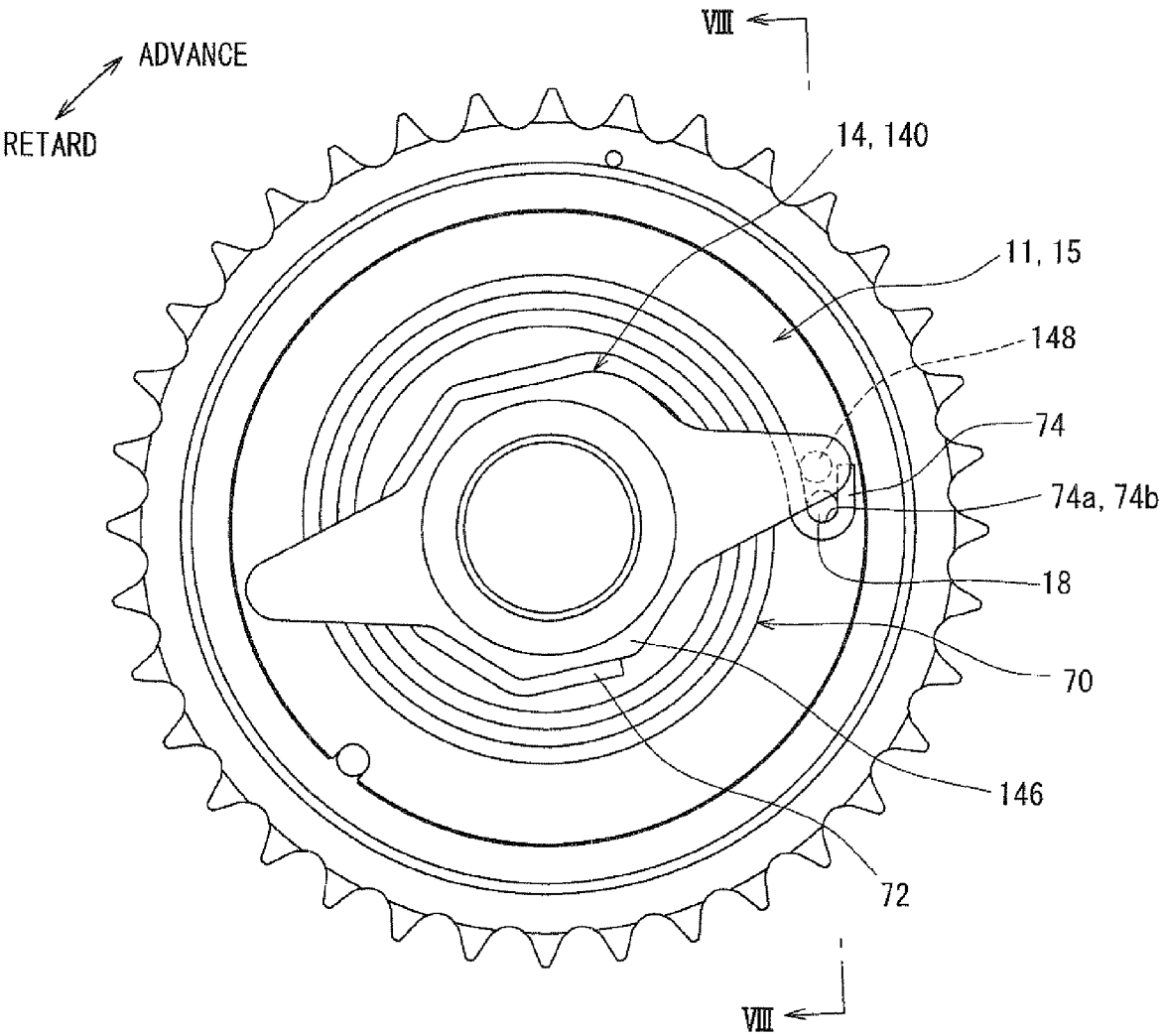
FIG. 6 is a schematic diagram for explaining operation of an urging structure shown in FIG. 4.

As shown in FIGS. 1 and 4, the first engagement part 74*a* generally corresponds to one half of the most radially outward part 74, and the first engagement part 74*a* is adjacent the front plate 15. The first engagement part 74*a* has an U-shape that opens in the retard direction of the rotational direction of the rotational shaft 140 relative to the housing 11. As shown in FIG. 6, when the rotational phase is in a range on a retard side of the start phase, the first engagement part 74*a* is engaged with the stopper 18 in a state, where arms of the U-shaped first engagement part 74*a* hold the first stopper 18 therebetween in the radial direction of the rotational shaft 140. As a result, the displacement of the first engagement part 74*a* in the radially inward direction is limited.

Figure 7:
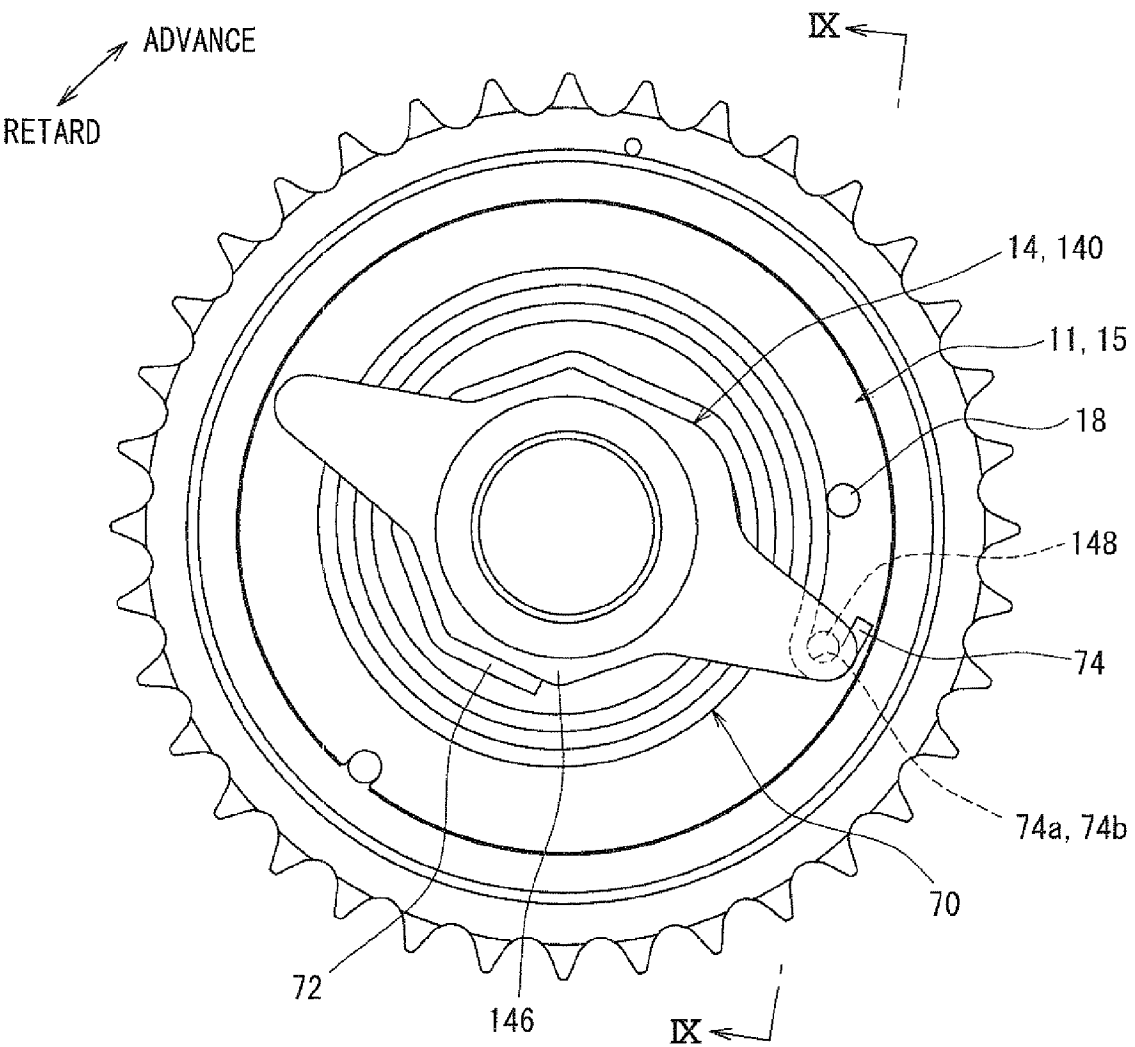
FIG. 7 is another schematic diagram for explaining the operation of the urging structure shown in FIG. 4.

As shown in FIGS. 1, 4, the second engagement part 74*b* generally corresponds to the other half of the most radially outward part 74 opposite from the one half (the first engagement part 74*a*), and is adjacent the arm 147*a*. Thus, the first engagement part 74*a* and the second engagement part 74*b* are arranged side by side along the longitudinal axis of the housing 11, for example. The second engagement part 74*b* has an U-shape that opens in the retard direction of the rotational direction of the rotational shaft 140 relative to the housing 11. As shown in FIG. 7, when the rotational phase is in a range on an advance side of the start phase, the second engagement part 74*b* is engaged with the second stopper 148 in a state, where arms of the U-shaped second engagement part 74*b* hold the second stopper 148 therebetween in the radial direction of the rotational shaft 140. As a result, the displacement of the second engagement part 74*b* in the radially inward direction is effectively limited.

The above curved shape of the most radially inward part 72 and the most radially outward part 74 of the spiral spring 70 may be made by inserting a metal wire rod into a space between dies and by pressing the wire rod into a shape. For example, the above wire rod has a thickness of 2 mm and a width of 7 mm.

Figure 8:
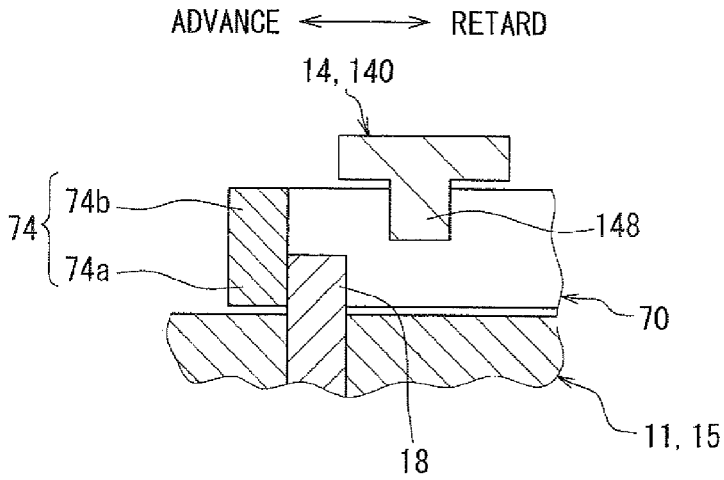
FIG. 8 is a cross-sectional view taken along line VIII-VIII in FIG. 6 for explaining the operation of the urging structure shown in FIG. 4.

Due to the above urging structure, when the rotational phase is shifted in a range on the retard side of the start phase, the first engagement part 74*a* of the most radially outward part 74 is engaged with the first stopper 18 of the housing 11, and the most radially inward part 72 of the spiral spring 1070 is engaged with the rotational shaft 140 of the vane rotor 140 as shown in FIGS. 6 and 8. In the above, the spiral spring 70 is twisted in the retard direction such that the second stopper 148 of the vane rotor 14 is spaced apart from the second engagement part 74*b* of the most radially outward part 74 of the spiral spring 70 in the retard direction. As a result, the vane rotor 14 is urged by the restoring force of the spiral spring 70 in the advance direction.

Figure 9:
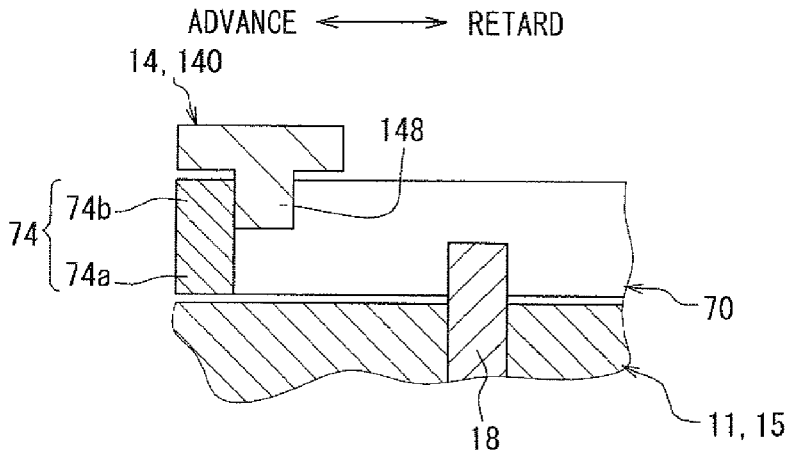
FIG. 9 is a cross-sectional view taken along a line IX-IV in FIG. 7 for explaining the operation of the urging structure shown in FIG. 4.

In contrast, when the rotational phase is shifted in a range on the advance side of the start phase, the second engagement part 74*b* of the most radially outward part 74 is engaged with the second stopper 148 of the vane rotor 14, and the most radially inward part 72 of the spiral spring 1070 is engaged with the rotational shaft 140 of the vane rotor 140 as shown in FIGS. 7 and 9. In the above, the first engagement part 74*a* of the most radially outward part 74 of the spiral spring 70 is spaced apart from the first stopper 18 in the advance direction, and thereby the vane rotor 14 is prevented from being urged by the spiral spring 70. In other words, the spiral spring 70 is not twisted even by the relative rotation of the vane rotor 14 relative to the housing 11 because the spiral spring 70, which is only engaged with the vane rotor 14 as above, is rotated integrally with the vane rotor 14. As a result, the restoring force of the spiral spring 70 is not generated, and thereby the vane rotor 14 is prevented from being urged by the restoring force of the spiral spring 70.

In the first embodiment, when the rotational phase is positioned at a phase on the retard side of the start phase, the spiral spring 70 is engaged with the first stopper 18 of the housing 11 and is also engaged with the rotational shaft 140 of the vane rotor 14. Thus, the vane rotor 14 is urged by the spiral spring to be shifted in the advance direction against the variable torque that is, in average, applied in the retard direction. In contrast, when the rotational phase is positioned at a phase on the advance side of the start phase, the spiral spring 70 is engaged with the second stopper 148 of the vane rotor 14 and is also engaged with the rotational shaft 140 of the vane rotor 14, and thereby the vane rotor 14 is urged only by the variable torque, which is applied, in average, in the retard direction, such that the vane rotor 14 is shifted in the retard direction. As a result, upon the stop of the internal combustion engine, it is possible to shift the rotational phase to the start phase either from the retard side or from the advance side of the start phase (or of the intermediate position). Thereby, it is possible to hold the rotational phase at the start phase during the starting of the internal combustion engine such that the startability of the engine is substantially achievable.

The most radially inward part 72 of the spiral spring 70 of the first embodiment is engaged with the bush 146, which constitutes the rotational shaft 140 of the vane rotor 14, in a state, where the most radially inward part 72 is wound around the bush 146 in the rotational direction of the vane rotor 14. Thus, the most radially inward part 72 is limited from deforming due to the rotation of the vane rotor 14 relative to the housing 11. Also, typically, the most radially inward part 72 of the first embodiment is wound to extend over the four corner portions 146*b* that are formed at the outer peripheral surface 146*a* of the bush 146 in an angular range of at least 180 degree in the rotational direction. As a result, the shape of the most radially inward part 72 is reliably stabilized, and also the erroneous displacement of the most radially inward part 72 from the engaged position is reliably limited. Furthermore, in the vane rotor 14, the most radially inward part 72 of the first embodiment is wound around the bush 146 over the corner portion 146*b* and is interposed between the bush 146 and the guide 149. Thus, the erroneous displacement of the most radially inward part 72 from the engaged position is effectively limited. Due to the above configuration, it is possible to prevent the generation of sliding resistance applied in the opposite directions due to the slide of the most radially inward part 72 on the bush 146 when the vane rotor 14 is rotated relative to the housing 11 in the retard direction and in the advance direction. In other words, it is possible to prevent the generation of the sliding resistance in the opposite directions due to the shifting of the rotational phase in the retard direction and in the advance direction.

In addition to the above advantage, it is possible to prevent parts of the wire of the spiral spring 70 of the first embodiment from contacting each other in the radial direction even when the spiral spring 70 is twisted due to the relative rotation of the vane rotor 14 relative to the housing 11. Furthermore, in the first embodiment, because the engagement part 74*a* or 74*b* of the most radially outward part 74 of the spiral spring 70 is engageable with the stopper 18 or 148, the displacement of the most radially outward part 74 in the radially inward direction is effectively prevented regardless of the rotational phase, and thereby the radial distance between the parts of the wire of the spiral spring 70 is effectively maintained. As a result, it is possible to prevent the generation of the sliding resistance between the parts of the wire of the spiral spring 70 in the opposite directions due to the shifting of the rotational phase in the retard direction and in the advance direction.

Figure 10:
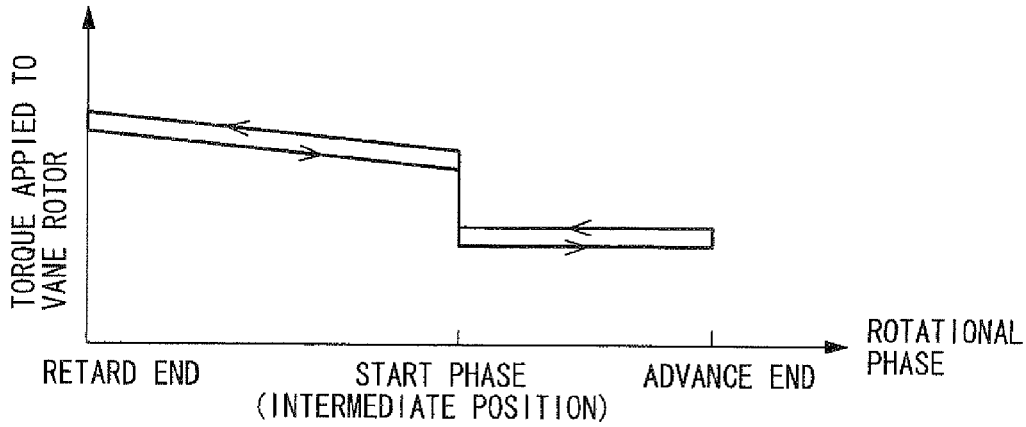
FIG. 10 is a characteristic diagram for explaining advantages of the operation of the urging structure shown in FIG. 4.
Figure 17:
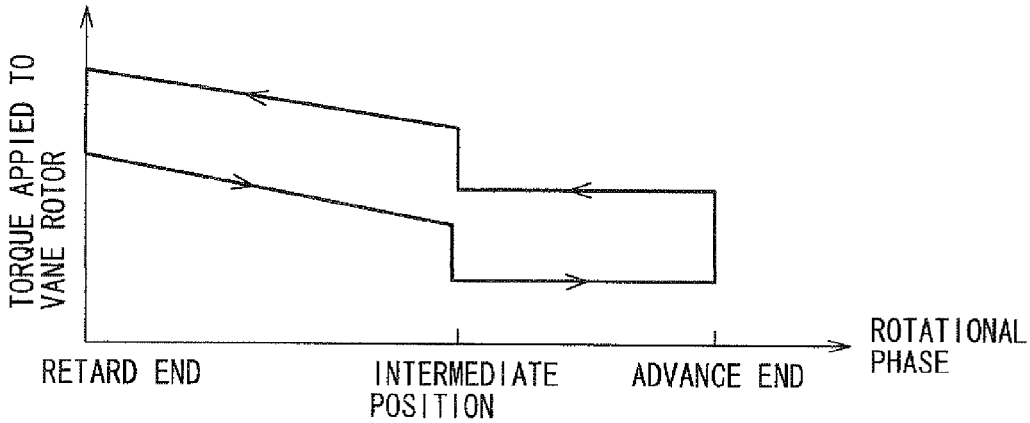
FIG. 17 PRIOR ART
FIG. 17 is an example characteristic diagram for explaining disadvantages in the prior art.

As above, in the first embodiment sliding resistance between the bush 146 and the most radially inward part 72 of the spiral spring 70 is effectively suppressed, and also sliding resistance between the parts of the wire of the spiral spring 70 is suppressed. As a result, the urging force by the spiral spring 70 applied to the vane rotor 14 and the sliding resistance applied to the vane rotor 14 provide torque having characteristics as shown in FIG. 10. In other words, hysteresis of torque applied to the vane rotor 14 during the shifting of the rotational phase in the retard direction and in the advance direction is effectively reduced compared with the hysteresis shown in FIG. 17. Thus, it is possible to accurately execute the adjustment of the rotational phase or of the valve timing by supplying hydraulic oil advantageously.

Second Embodiment

Figure 11:
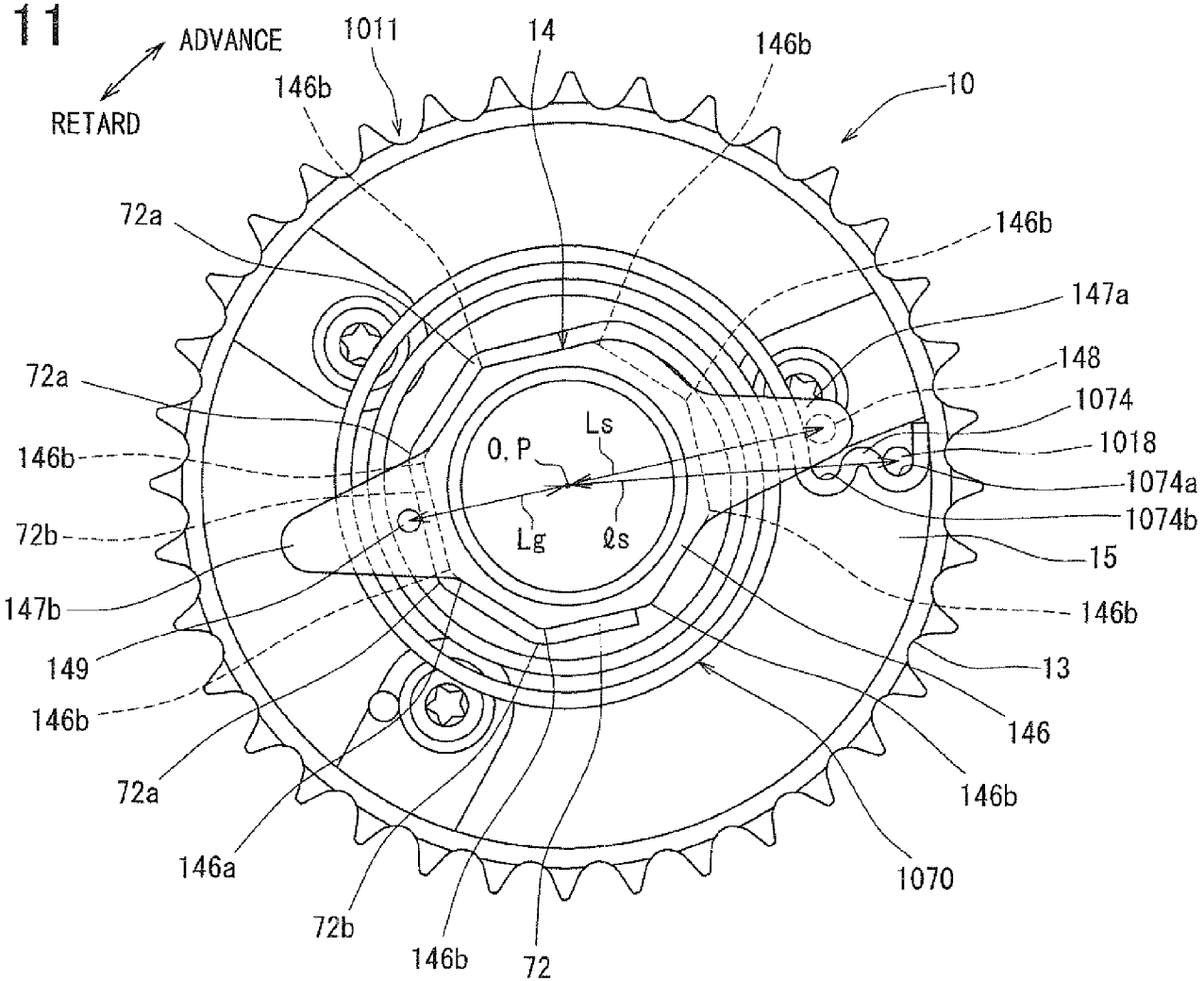
FIG. 11 is a diagram of a drive unit of a valve timing adjusting apparatus according to the second embodiment of the present invention observed in the direction IV-IV in FIG. 1.

As shown in FIG. 11, the second embodiment of the present invention is a modification of the first embodiment. A first stopper 1018 of a housing 1011 of the second embodiment is provided at a position radially outward of the second stopper 148 of the vane rotor 14 of the first embodiment. In other words, the first stopper 1018 is off the rotation center O of the rotational shaft 140 by a distance Is that is greater than the preset distance Ls, by which the second stopper 148 is off the rotation center O.

Furthermore, in the second embodiment, a spiral spring 1070 is also made of the hairspring. The spiral spring 1070 has a most radially outward part 1074 that is curved into an ω-shape such that first and second engagement parts 1074*a*, 1074*b* are formed. The first engagement part 1074*a* is formed at a position that is off the rotation center O of the rotational shaft 140 by a distance that is substantially similar to the distance is, by which the first stopper 1018 is off the rotation center O. In contrast, the second engagement part 1074*b* is formed at a position that is off the rotation center O by a distance substantially similar to the distance Ls, by which the second stopper 148 is off the rotation center O.

Figure 12:
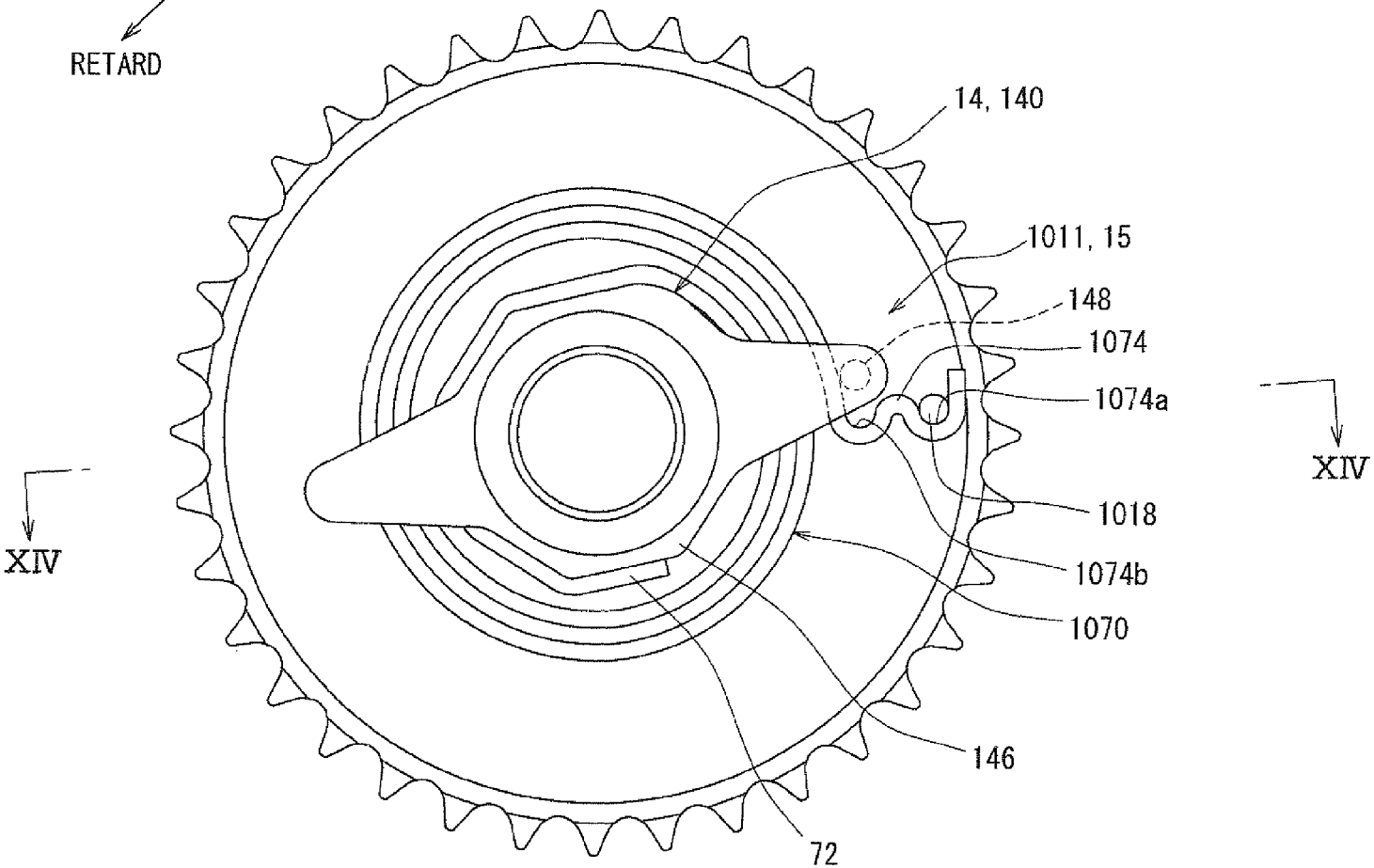
FIG. 12 is a schematic diagram for explaining operation of an urging structure shown in FIG. 11.
Figure 13:
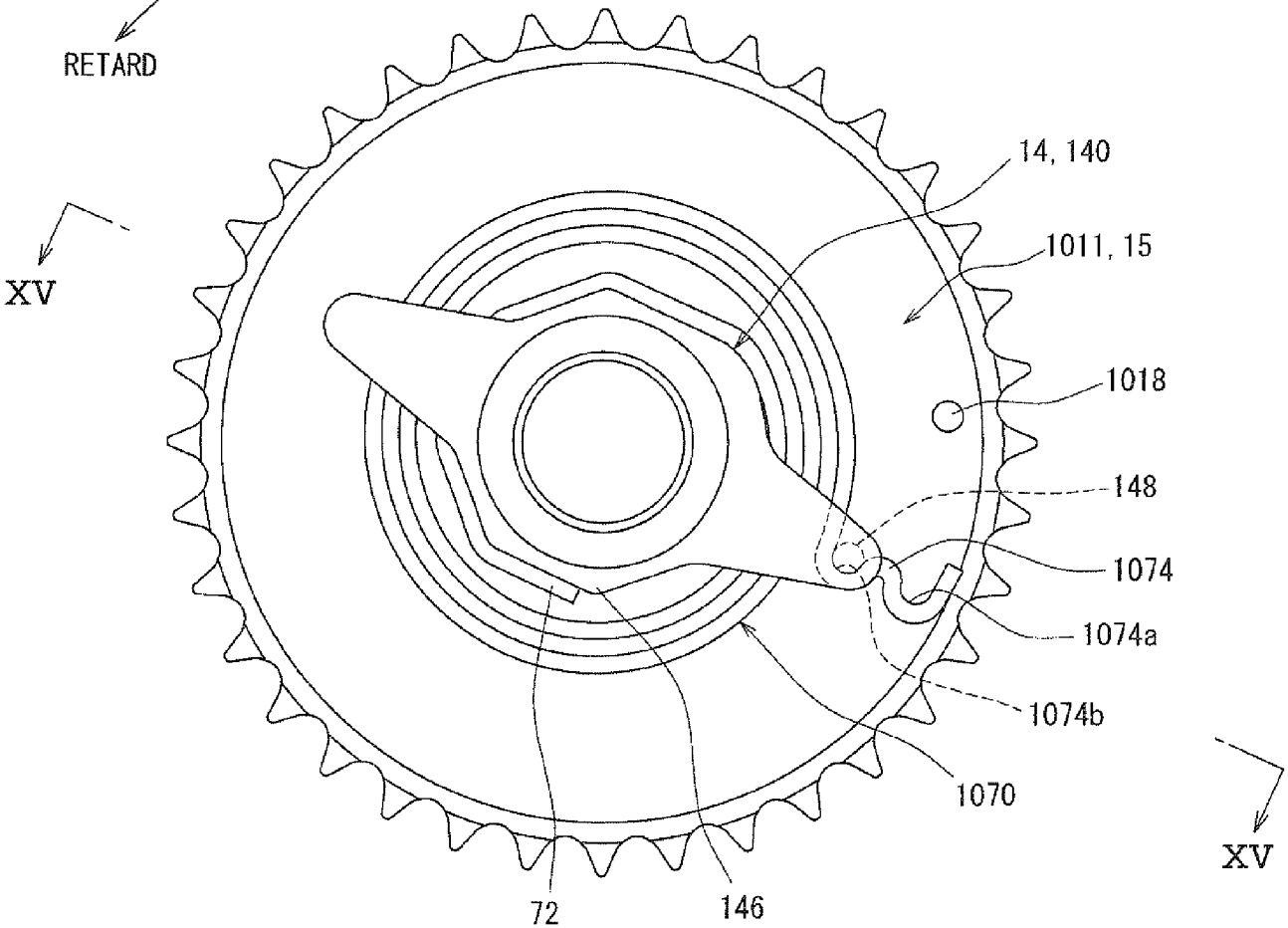
FIG. 13 is a schematic diagram for explaining the operation of the urging structure shown in FIG. 11.

Due to the above setting of the distances, each of the engagement parts 1074*a*, 1074*b*, which are displaced from each other in the radial direction of the rotational shaft 140, has a U-shape that opens in the retard direction of the rotational direction of the rotational shaft 140 relative to the housing 1011. As shown in FIG. 12, when the rotational phase is shifted in a range on the retard side of the start phase, the first engagement part 1074*a* is engaged with the stopper 1018 in a state, where arms of the U-shaped first engagement part 1074*a* hold the first stopper 1018 therebetween in the radial direction of the rotational shaft 140. As a result, the displacement of the first engagement part 1074*a* in the radially inward direction is effectively limited. In contrast, as shown in FIG. 13, when the rotational phase is shifted in a range on the advance side of the start phase, the second engagement part 1074*b* is engaged with the stopper 148 in a state, where arms of the U-shaped second engagement part 1074*b* hold the second stopper 148 therebetween in the radial direction of the rotational shaft 140. As a result, the displacement of the second engagement part 1074*b* in the radially inward direction is effectively limited.

Figure 14:
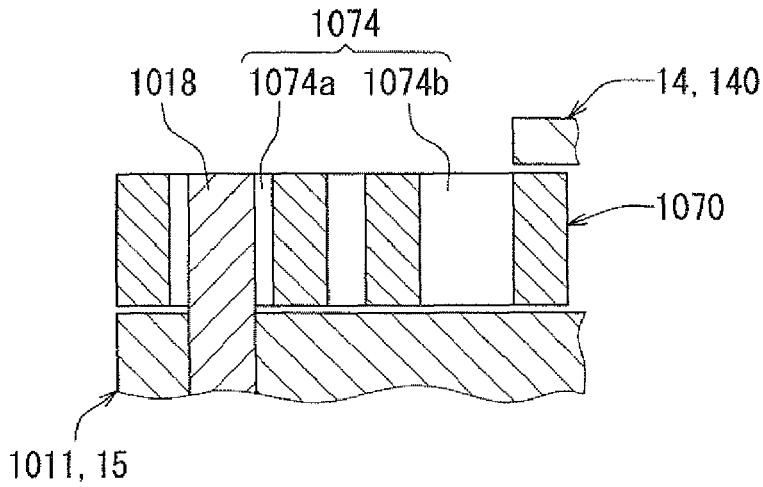
FIG. 14 is a cross-sectional view taken along a line XIV-XIV in FIG. 12 for explaining the operation of the urging structure shown in FIG. 11.

Due to the above configuration, when the rotational phase is shifted in the range of the retard side of the start phase, the first engagement part 1074*a* of the most radially outward part 1074 of the spiral spring 1070 is engaged with the first stopper 1018 of the housing 11, and the most radially inward part 72 of the spiral spring 1070 is engaged with the rotational shaft 140 of the vane rotor 140 as shown in FIGS. 12 and 14. In the above, because the second engagement part 1074*b* of the most radially outward part 1074 of the spiral spring 1070 is spaced apart from the second stopper 148 in the retard direction, the vane rotor 14 is urged by the spiral spring 1070 in the advance direction.

Figure 15:
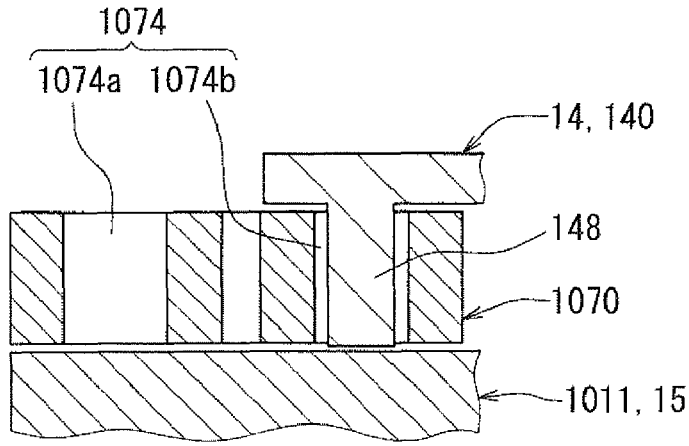
FIG. 15 is a cross-sectional view taken along line XV-XV in FIG. 13 for explaining the operation of the urging structure shown in FIG. 11.

In contrast, when the rotational phase is shifted in the range on the advance side of the start phase, the second engagement part 1074*b* of the most radially outward part 1074 of the spiral spring 1070 is engaged with the second stopper 148 of the vane rotor 140, and the most radially inward part 72 of the spiral spring 1070 is engaged with the rotational shaft 140 of the vane rotor 140 as shown in FIGS. 13 and 15. In the above, because the first engagement part 1074*a* of the most radially outward part 1074 of the spiral spring 1070 is spaced apart from the first stopper 1018 in the advance direction, the vane rotor 14 is prevented from being urged by the spiral spring 1070.

In the second embodiment, when the rotational phase is in a range on the retard side of the intermediate position, the spiral spring 1070 is engaged with the first stopper 1018 of the housing 1011 and with the rotational shaft 140 of the vane rotor 14. As a result, the vane rotor 14 is urged by the spiral spring 1070 to be shifted in the advance direction against the variable torque that is, in average, applied in the retard direction. Also, in contrast, when the rotational phase is in a range on the advance side of the intermediate position, the spiral spring 1070 is engaged with the second stopper 148 of the vane rotor 14 and with the rotational shaft 140 of the vane rotor 14. As a result, the vane rotor 14 is urged only by the variable torque that is, in average, applied in the retard direction such that the vane rotor 14 is shifted in the retard direction. Due to the above, similar to the first embodiment, upon the stopping of the internal combustion engine, it is possible to shift the rotational phase to the start phase from both sides of the start phase, and thereby it is possible to achieve the reliable performance for starting the engine.

By the principle similar to the first embodiment, according to the spiral spring 1070 of the second embodiment, the sliding resistance between the most radially inward part 72 and the bush 146 is suppressed, and the sliding resistance between the parts of the wire of the spiral spring 1070 is also suppressed. As a result, hysteresis of torque applied to the vane rotor 14 is effectively reduced. Accordingly, it is possible to accurately execute the adjustment of the rotational phase or the valve timing by supplying hydraulic oil.

Other Embodiment

Multiple embodiments of the present invention have been described as above. However, the present invention is not limited to the above embodiments. The present invention is applicable to various embodiments provided that the various embodiments do not deviate from the gist of the present invention.

Figure 16:
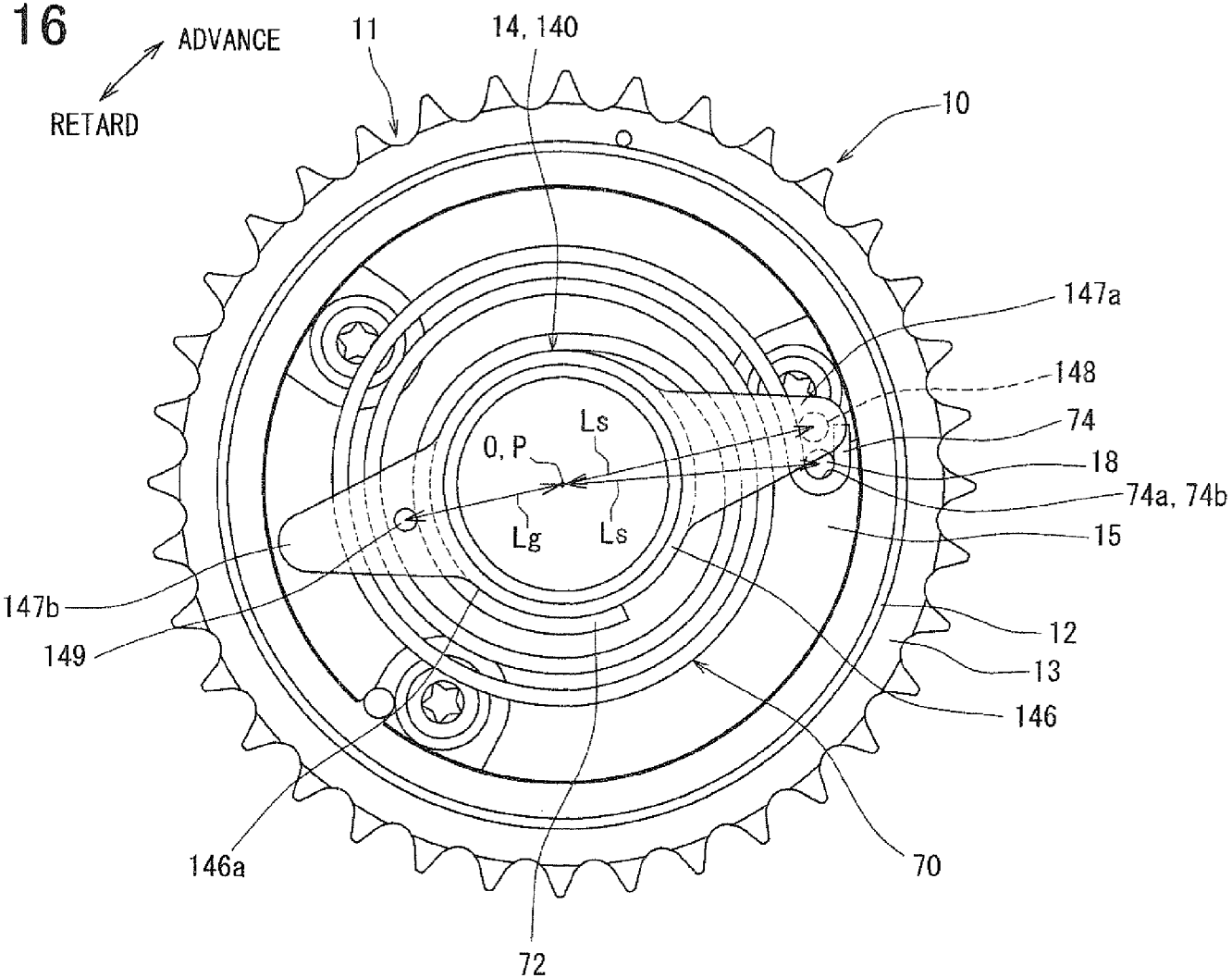
FIG. 16 is a diagram illustrating a modification of FIG. 4.

Specifically, FIG. 16 shows the modification of the first embodiment shown in FIG. 4. As shown in FIG. 16, in the rotational shaft 140 of the vane rotor 14, the outer peripheral surface 146*a* of the bush 146 may alternatively form a cylindrical surface. In the above case, the most radially inward part 72 of the spiral spring 70, 1070 is wound around the outer peripheral surface 146*a* in the angular range of at least 180 degree. Further alternatively, the outer peripheral surface 146*a* of the bush 146 may have a cross-sectional shape of a polygonal shape that is different from the octagonal shape, for example, such that the outer peripheral surface 146*a* has at least one corner portion 146*b*. Furthermore, the guide 149, which and the outer peripheral surface 146*a* of the bush 146 holds therebetween the most radially inward part 72 of the spiral spring 70, 1070, may not be provided alternatively.

The spiral spring 70 may be alternatively made of another flat spiral spring, which is substantially formed on a plane, and parts of the wire of which contact each other in the radial direction. Also, the engagement part of the spiral spring 70, which corresponds to the stopper 18, 1018, 148, may be located at a position radially between the most radially inward part 72 and the most radially outward part 74.

The rotational direction of the housing 11, 1011 and the vane rotor 14 of the first and second embodiments may be reversed such that the housing 11, 1011 and the vane rotor 14 rotate counterclockwise in FIGS. 2, 4, and 11, for example. In the above case, the relation of the "advance" and "retard" in the rotational direction becomes opposite from the directional relation in the above embodiments. In other words, when the rotational phase is in the range on the advance side of the start phase, the spiral spring 70, 1070 urges the vane rotor 14 in the retard direction in the modification.

Furthermore, the present invention may be alternatively applied to the other apparatus that is different from the apparatus for adjusting the valve timing of the intake valve. For example, the present invention may be alternatively applied to an apparatus for adjusting the valve timing of an exhaust valve serving as a "valve", and applicable to an apparatus for adjusting the valve timing of both the intake valve and the exhaust valve.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus for adjusting a valve timing of a valve that is opened and closed by a camshaft based on a torque transmitted from the crankshaft in an internal combustion engine, the valve timing adjusting apparatus comprising:

a housing that is rotatable synchronously with the crankshaft, wherein the housing has a stopper;

a vane rotor that integrally includes a rotational shaft and a vane, wherein: the rotational shaft is rotatable synchronously with the camshaft; the vane defines an advance chamber and a retard chamber in the housing; the advance chamber and the retard chamber are arranged one after another in a rotational direction of the vane rotor; and supply of working fluid to the retard chamber or the advance chamber generates a shift of a rotational phase of the vane rotor relative to the housing in a retard direction or in an advance direction, respectively; and a spiral spring that has a most radially inward part engaged with the rotational shaft in a state that the most radially inward part is wound around the rotational shaft, wherein: the rotational phase has an intermediate position defined between a full retard position and a full advance position of the rotational phase; the spiral spring has a radially outward segment that is located at a position radially outward of the most radially inward part; and when the rotational phase is in a range on a retard side of the intermediate position or on an advance side of the intermediate position, the radially outward segment of the spiral spring is engaged with the stopper of the housing such that the spiral spring urges the vane rotor in the advance direction or in the retard direction relative to the housing, respectively, wherein the stopper of the housing is a first stopper, wherein the vane rotor has a second stopper, wherein, when the rotational phase is in the range on the retard side of the intermediate position, the radially outward segment of the spiral spring positioned radially outward of the most radially inward part is engaged with the first stopper, and wherein, when the rotational phase is in the range on the advance side of the intermediate position, the radially outward segment of the spiral spring positioned radially outward of the most radially inward part is engaged with the second stopper.

2. The valve timing adjusting apparatus according to claim 1, wherein the vane rotor is urged, in average, in the retard direction relative to the housing by variable torque that is transmitted to the vane rotor from the camshaft; and when the rotational phase is in the range on the retard side of the intermediate position, the radially outward segment of the spiral spring is engaged with the stopper such that the spiral spring urges the vane rotor in the advance direction relative to the housing.

3. The valve timing adjusting apparatus according to claim 1, wherein each of the first stopper and the second stopper has a column shape that extends along a longitudinal axis of the rotational shaft;

the radially outward segment of the spiral spring positioned radially outward of the most radially inward part includes a most radially outward part; and the most radially outward part includes:

a first engagement part that has a U-shape opening in the rotational direction of the rotational shaft, wherein the first engagement part holds the first stopper in a radial direction of the rotational shaft when the first engagement part is engaged with the first stopper; and a second engagement part that has a U-shape opening in the rotational direction of the rotational shaft, wherein the second engagement part holds the second stopper in the radial direction of the rotational shaft when the second engagement part is engaged with the second stopper.

4. The valve timing adjusting apparatus according to claim 1, wherein the spiral spring is made of a hairspring; and wire parts of the hairspring is spaced apart from each other in a radial direction of the spiral spring.

5. The valve timing adjusting apparatus according to claim 1, wherein the most radially inward part is wound around the rotational shaft in an angular range of at least 180 degree in the rotational direction.

6. The valve timing adjusting apparatus according to claim 1, wherein the rotational shaft includes one corner portion having an outline that bends in a radial direction of the rotational shaft; and the most radially inward part is wound around the rotational shaft to extend over the one corner portion.

7. The valve timing adjusting apparatus according to claim 6, wherein the rotational shaft has an outline shape, which is a polygonal shape having a plurality of corner portions; and the most radially inward part is wound around the rotational shaft to extend over the plurality of corner portions that are provided to the rotational shaft in an angular range of at least 180 degree in the rotational direction.

8. The valve timing adjusting apparatus according to claim 6, wherein the vane rotor has a guide such that the most radially inward part is interposed between the guide and the rotational shaft.

* * * * *